United States Patent [19]

Stull

[11] Patent Number: 4,842,169

[45] Date of Patent: Jun. 27, 1989

[54] TWIST CAP HAVING ADJUSTABLE FLOW RATE

[76] Inventor: Gene Stull, 5 Oak St., Chester, N.J. 07930

[21] Appl. No.: 188,855

[22] Filed: May 2, 1988

Related U.S. Application Data

[62] Division of Ser. No. 10,464, Feb. 3, 1987, Pat. No. 4,754,899.

[51] Int. Cl.[4] ..... B65D 47/00

[52] U.S. Cl. ..... 222/521; 222/554

[58] Field of Search ..... 222/521, 520, 525, 153, 222/541, 548, 549, 499, 554, 552; 215/311, 313

[56] References Cited

U.S. PATENT DOCUMENTS

| | | | |
|---|---|---|---|
| 2,542,350 | 2/1951 | Paulsen | 222/521 |
| 3,598,285 | 8/1971 | Stull | 222/521 |
| 4,424,918 | 1/1984 | Stull | 222/521 |
| 4,438,870 | 3/1984 | Stull | 222/521 |
| 4,474,314 | 10/1984 | Roggenberg Jr. | 222/521 |

FOREIGN PATENT DOCUMENTS

| | | | |
|---|---|---|---|
| 324547 | 1/1956 | Switzerland | 222/521 |

*Primary Examiner*—Joseph J. Rolla
*Assistant Examiner*—Kenneth Noland
*Attorney, Agent, or Firm*—H. Gibner Lehmann; K. Gibner Lehmann

[57] ABSTRACT

A dispensing cap construction including a base cap attachable to a container, the base cap having a spout formation provided with a side wall and with a flow passage in the side wall, and a cover cap which is both turnably mounted on the base cap and axially movable thereon between a lowered sealing position and a raised dispensing position. The cover cap has a discharge orifice, and a valving wall and discharge passage in the valving wall, both of which move circumferentially around the side wall of the spout formation. The valving wall moves into and out of a sealing position wherein it covers or uncovers the flow passage in the side wall of the base cap when the cover cap is turned. The valving wall has positions intermediate its full cover and full uncover positions wherein it only partially closes the flow passage. The discharge orifice of the cover cap is sealed at a point downstream of the flow passage of the base cap when the cover cap is in its lowered position thereon.

3 Claims, 2 Drawing Sheets

TWIST CAP HAVING ADJUSTABLE FLOW RATE

SPONSORED RESEARCH AND DEVELOPMENT

Research and development of the present invention and application have not been Federally-sponsored, and no rights are given under any Federal program.

CROSS REFERENCE TO RELATED APPLICATIONS

This is a division of application Ser. No. 10,464, filed Feb. 3, 1987, now U.S. Pat. No. 4,754,899.

BACKGROUND OF THE INVENTION

1. Field of the Invention

This invention relates generally to hand-held dispensers, and more particularly to dispensers of the type having a base cap part that is applied to a container, and an overcap or twist cap applied to the base cap, and wherein discharge of the container contents is controlled by manually turning the twist cap between an open, discharging position and a closed, sealing position.

2. Description of the Related Art Including Information Discussed Under 37 CFR SS1.97-1.99

One prior twist cap construction is illustrated and described in my U.S. Pat. No. 4,424,918, and relates to a non-resealable dispenser construction. A twist or cover cap is turnably carried on a base cap in such a manner that when the cover cap is initially unscrewed, a shoulder on the latter is received in a groove on the base cap and the resulting interference therebetween prevents the twist cap from being pushed down and re-seated on the base cap. Inadvertent build-up of pressure in the dispenser is thus prevented, following initial use.

This patented dispenser incorporated no means for controlling the flow of product being discharged. The rate of discharge was determined by the size of the openings on opposite sides of the stopper peg, and the viscosity of the liquid.

U.S. Pat. No. 4,438,870 shows a different construction wherein a twist cap is raised by cam lugs carried on its underside and which engage cam tracks on a base cap, and is retracted by cooperable threads on both the twist and base caps. While this construction was capable of providing an adjustable flow, control was difficult to set or calibrate, since it depended for the most part on the relatively sudden removal of the stopper peg from the orifice in the twist cap. In actuality, the control was more in the nature of a simple "on-off" type of control, rather than one providing continuous adjustment over a reasonably well defined range.

Thus, the capability of providing a simple and foolproof high precision adjustable discharge function in a twist cap was not provided in any of the devices disclosed in the patents listed above.

A number of other twist cap constructions have been proposed and produced. It is believed that the above identified two patents constitute the closest prior art of which applicant is aware.

SUMMARY OF THE INVENTION

The above disadvantages and drawbacks of prior dispensing cap constructions are obviated by the present invention which has for one object the provision of a novel and improved dispensing cap which is both extremely simple in operation, and which provides a calibrated, adjustable-rate discharge of the contents so as to enable the consumer to dispense, with a high degree of accuracy, the precise amount of product desired.

A related object of the invention is to provide an improved dispensing cap construction as above set forth, wherein a flow rate can be pre-set by the consumer, prior to the occurrence of any discharge of the product.

Still another object of the invention is to provide an improved dispensing cap construction as above characterized, wherein a predetermined discharge flow rate can be "dialed" or set, and following use of the dispenser and closing of the same, the exact same flow rate re-set at a later time.

Yet another object of the invention is to provide an improved dispensing cap construction of the kind indicated, wherein a plurality of different, calibrated flow rates can be set by the consumer, either prior to or during use of the dispenser.

A still further object of the invention is to provide an improved dispensing cap construction as outlined above, wherein the flow rate mechanism, once set, resists subsequent inadvertent movement which might otherwise disturb the initially selected, desired setting.

Still another object of the invention is to provide an improved dispensing cap construction wherein the components can be readily fabricated as molded parts in simple mold cavities, thus maintaining the manufacturing costs as low as possible.

Yet another object of the invention is to provide an improved dispensing cap construction in accordance with the foregoing wherein two separate and distinct closed, sealing positions can be utilized, one adapted for a temporary sealing of the dispenser, and a second, more permanent sealing position intended for use when the dispenser is initially filled at the factory, and shipped to a distributor, warehouse, store, etc.

The above objects are accomplished by a dispensing cap construction comprising a base cap attachable to a container, the base cap having a spout formation provided with a side wall and with a flow passage in the side wall, and a cover cap which is both turnably mounted on the base cap and axially movable thereon between a lowered sealing position and a raised dispensing position. The cover cap has a discharge orifice, and a valving wall and discharge passage in the valving wall, both of which move circumferentially around the side wall of the spout formation. The valving wall moves into and out of a sealing position wherein it covers or uncovers the flow passage in the side wall of the base cap when the cover cap is turned. The valving wall has positions intermediate its full cover and full uncover positions wherein it only partially closes the flow passage. The discharge orifice of the cover cap is sealed at a point downstream of the flow passage of the base cap when the cover cap is in its lowered position thereon.

Other features and advantages will hereinafter appear.

BRIEF DESCRIPTION OF THE DRAWINGS

In the drawings, illustrating a preferred embodiment of the invention.

DESCRIPTION OF THE PREFERRED EMBODIMENT

Figure 1:
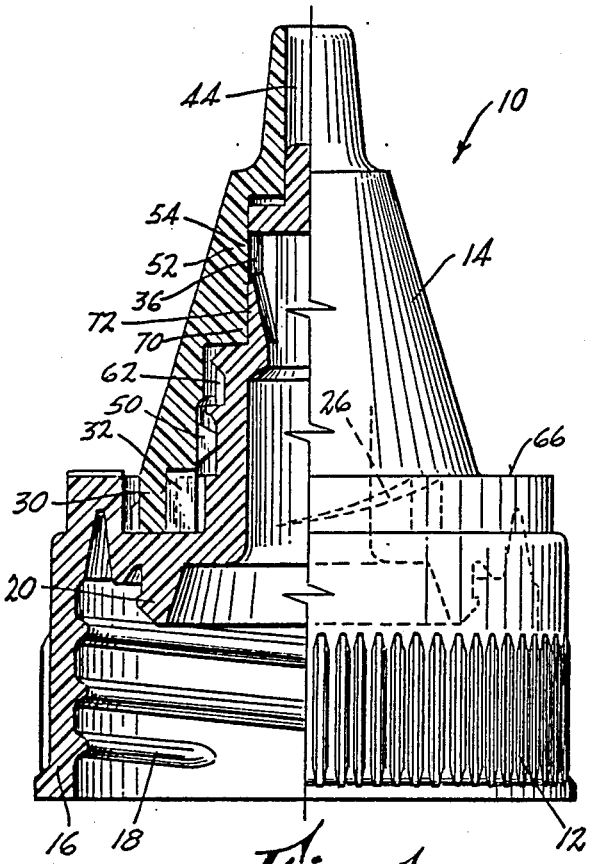
FIG. 1 is a view, partly in side elevation and partly in axial section, of the adjustable flow rate dispenser cap construction made in accordance with the present invention. The device is shown in a fully closed, sealing position.
Figure 2:
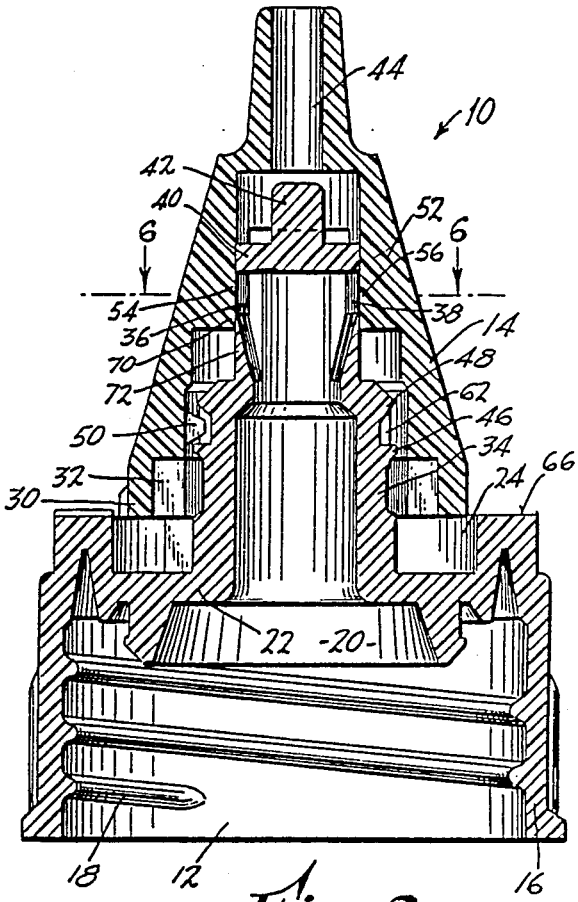
FIG. 2 is an axial section of the adjustable flow rate dispenser cap construction on FIG. 1, shown with the cover or twist cap in a raised position on the base cap, and with a valving wall of the cover cap closing off flow passages in a spout formation of the base cap.
Figure 3:
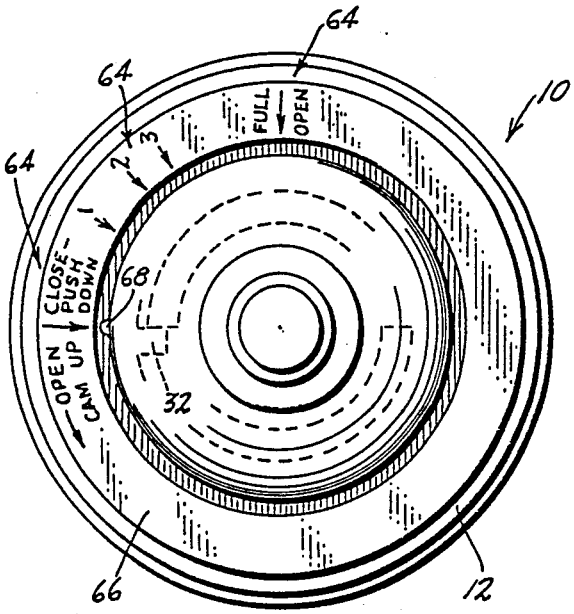
FIG. 3 is a top plan view of the adjustable flow rate dispenser cap construction of FIGS. 1 and 2, shown with the cover cap in a fully closed sealing position on the base cap.

Referring first to FIGS. 1–3 there is illustrated a dispensing cap construction designated generally by the numeral 10, comprising a base cap 12 and a cover cap or twist cap 14 carried thereby. The base cap 12 has a depending skirt 16 with internal screw threads 18 intended to mate with cooperable external threads on the neck of a container (not shown). An inner skirt 20 is provided, and is received in the container opening so as to form a seal therewith, all in the usual manner.

Figure 4:
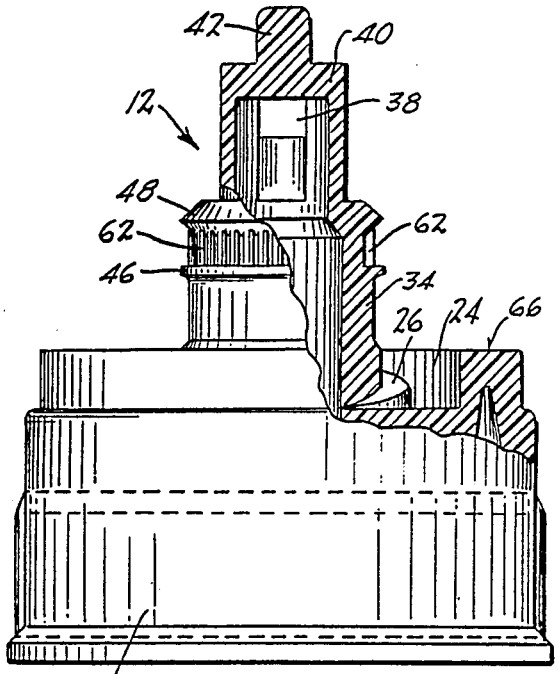
FIG. 4 is a view, partly in side elevation and partly in axial section, of the base cap of the construction of FIGS. 1–3. The base cap is shown rotated 90° from the view of FIG. 2.
Figure 5:
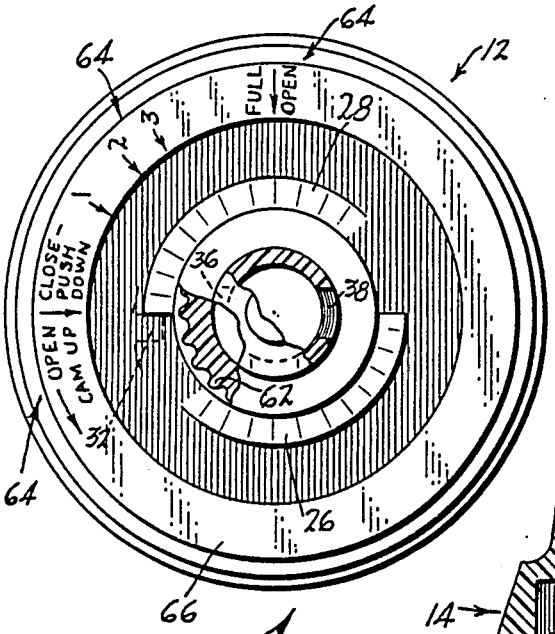
FIG. 5 is a top plan view, partly broken away, of the base cap of the construction of FIGS. 1–4.

The base cap 12 is particularly illustrated in FIGS. 4 and 5. It has a transverse top wall 22, FIG. 2, and an annular peripheral recess 24, FIGS. 2 and 4, formed therein. Disposed within the recess 24 is a pair of arcuate cam tracks 26 and 28, each extending through an angle on the order of 135 degrees, although other track lengths could be substituted for those shown.

Figure 10:
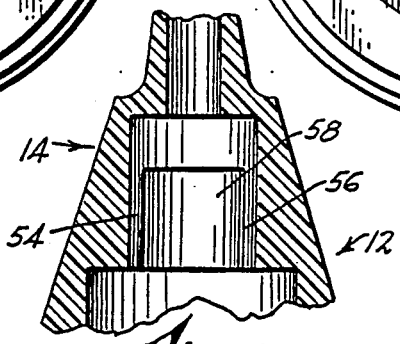
FIG. 10 is a fragmentary axial section of the twist cap, particularly showing the discharge passage therein, such passage having an upper tubular portion, and a lower portion constituted as a semi-cylindrical recess in the valving wall of the twist cap.
Figure 9:
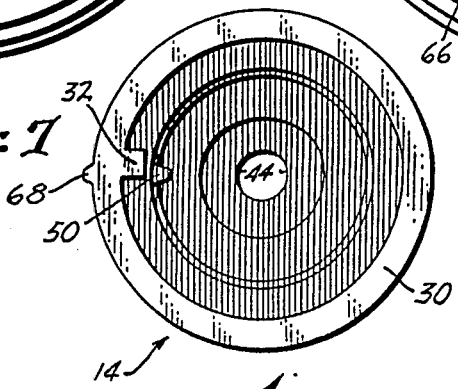
FIG. 9 is a bottom plan view of the cover or twist cap of the construction of FIGS. 1–3 and 6–8.

The twist cap 14 is particularly illustrated in FIGS. 9 and 10. It has a depending skirt 30 which is received in the annular recess 24 of the base cap 12 when the two are assembled and the twist cap 14 is disposed in the fully seated, closed, sealing position as in FIG. 1. Disposed on the underside of the twist cap, and extending radially inwardly from the skirt is a lug 32 constituting a cam follower, FIG. 9, which is intended to ride up one of the cam tracks 26, 28 of the base cap 12 as the twist cap 14 is turned in an unscrewing direction. As can be readily seen, the twist cap 14 is moveable axially on the base cap 12, and as the cam lug 32 rides up the cam track 26, it carries with it the twist cap 14.

In FIG. 4, the base cap 12 is provided with an upstanding spout portion 34 having a bore that communicates with the area adjacent the threads 18 of the base cap. The spout portion 34 has an annular side wall containing diametrically opposed arcuate cut-out portions constituting flow passages 36, 38 for liquid to pass through. The passages are illustrated particularly in FIGS. 6–8. At the top of the spout portion 34 is a transverse wall 40 carrying an upstanding stopper pin or sealing peg 42 that is receivable in an upper discharge passage 44 in the twist cap, this upper passage 44 constituting a discharge orifice. The sealing relationship of the peg 42 and the walls of the orifice 44 is shown in FIG. 1. The outer surface of the annular wall of the spout has a pair of spaced annular external beads 46 and 48. The lower bead 46 is intended to be by-passed by a cooperable inwardly extending retainer and ratchet tooth 50, of the twist cap 14, FIGS. 2 and 9, as the twist cap arrives at a raised position wherein the lug 32 thereof is nearing the upper end of the cam track 26, during initial unscrewing of the twist cap 14.

The twist cap 14 has an annular side wall, the exterior surface of which is generally conical, and the inner surface of which is stepped.

Figure 6:
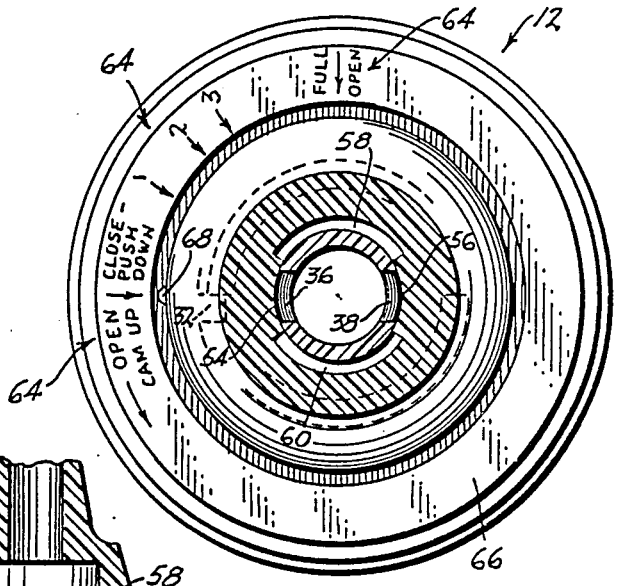
FIG. 6 is a horizontal section taken on the line 6—6 of FIG. 2. The twist cap is illustrated as having been turned to a position wherein valving walls thereof completely close off flow passages in the spout formation of the base cap.
Figure 7:
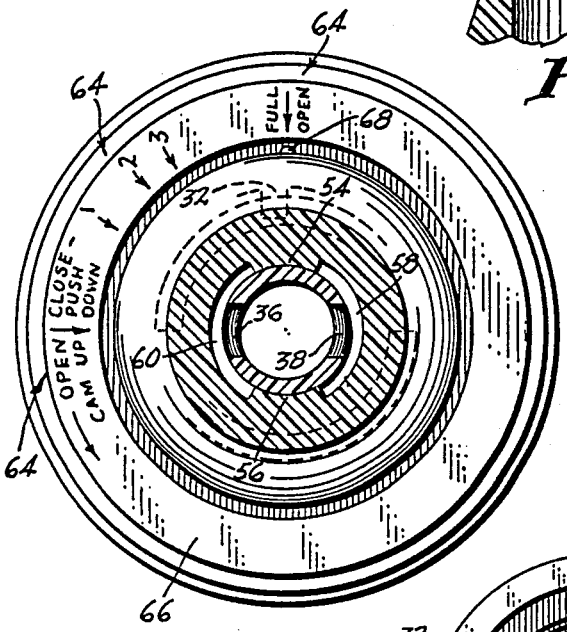
FIG. 7 is a view like that of FIG. 6, except showing the cover cap turned to a position wherein the valving walls of the cover cap fully uncover or expose flow passages in the spout formation of the base cap, thereby permitting a high rate of discharge of the dispenser contents to occur.
Figure 8:
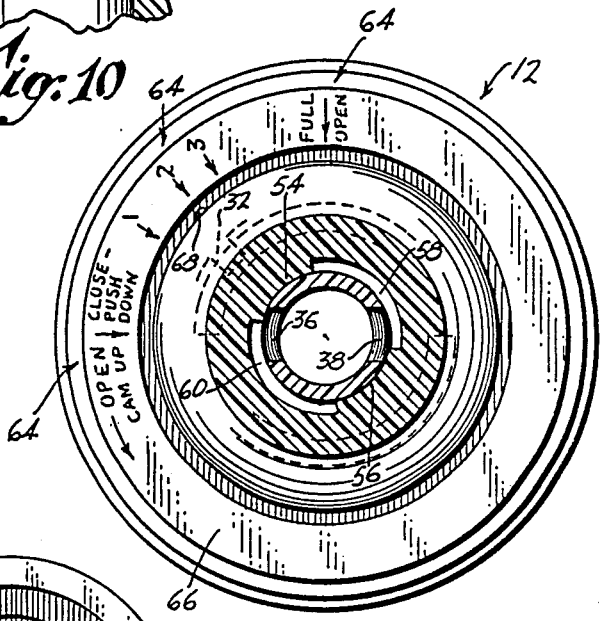
FIG. 8 is a view like FIGS. 6 and 7, except showing the cover cap turned to an intermediate position, wherein the valving walls of the cover cap only partially cover the flow passages in the spout formation of the base cap, thereby permitting a precisely calibrated discharge of the dispenser contents to occur.

In accordance with the present invention, a central portion of the stepped wall is cooperable with the flow passages 36, 38 of the spout portion 34, and constitutes a valving wall 52 that controls movement of product through the flow passages 36 and 38 by forming two oppositely disposed arcuate surfaces or shutters 54 and 56 capable of moving across and blocking the passages. As best seen in FIGS. 6–8, the shutters 54, 56 are carried by, and thus turn with the twist cap 14. Arcuate recesses 58, 60 in the valving wall 52, constituting lower discharge passages of the twist cap 14, are defined by the opposite shoulders of the shutters 54 and 56. These recesses or grooves are shallow and wide, being also illustrated in FIGS. 6–8. In the appended claims the peg 42 and lower end of the passage 44 are referred to as a cooperable sealing means closing off the remainder of the dispensing orifice 44. Also, the valving wall 52, comprising shutters 54 and 56, and the flow passages 36, 38 are referred to as cooperable valving means separate and distinct from the sealing means, and responsive to turning of the cover cap when it is in its raised position on the base cap, for selectively establishing and interrupting communication between the bore of the spout formation and the dispensing orifice of the cover cap.

By the invention there is provided a plurality of axially aligned, longitudinal ribs 62 extending between the annular beads 46, 48, as in FIG. 4. The ribs 62 define a plurality of vertical grooves and thus constitute, with the tooth 50, a ratchet mechanism. The ribs are shown in the broken away portion of FIG. 5. During unscrewing of the twist cap 14, this tooth 50 snaps past the lower bead 46, arriving at the space between the beads 46, 48, and becomes seated in one of the vertical grooves defined by the ribs 62. The ratchet action of the tooth 50 and ribs 62 restrains the twist cap against inadvertent turning movement in the absence of a manually applied turning force thereto. It thus constitutes a yieldable detent.

FIG. 6 illustrates the relative positions of the valving wall shutters 54, 56 and flow passages 36, 38 corresponding to a complete seal of the dispenser. That is, portions 54, 56 of the valving wall 52 completely cover the flow passages 36, 38 of the spout portion 34.

In FIG. 7, the shutters 54, 56 have been shifted 90° to positions wherein the flow passages 36, 38 lie radially within the recesses 60, 58 between the shutters 54, 56, this corresponding to a fully open, discharging position of the twist cap. FIG. 8 illustrates a condition wherein the valving wall portions or shutters 54, 56 of the twist cap close off just under one-half of each flow passage 36, 38, giving rise to a partial restriction of product flow.

Also, by the invention, there are provided cooperable marker means comprising indicia 64 on an annular flat surface 66 of the base cap 12 and an index mark on the lower portion of the twist cap, for indicating the relative positions of the valving wall shutters 54, 56 and flow passages 36, 38. For example, the index mark can take the form of an external nib 68 on the twist cap 14, and can be aligned with an arrow designated "FULL OPEN" on the base cap 12, which would correspond to the showing of FIG. 7. Similarly, the twist cap 14 can be turned such that the nib 68 will align with the designations "3", "2", or "1", indicating successive reduction in flow through the flow passages 36, 38. With the nib 68 aligned with the arrow "CLOSE-PUSH DOWN", the shutters 54, 56 completely cover the flow passages 36, 38, as in FIG. 6; in addition, the cam lug 32 overlies the region adjacent the end or shoulder of the cam track 28, the lug being shown in dotted outline in FIG. 5. In this position, the dispenser is in a sealing condition; it can be opened by merely turning the twist cap 14 in either a clockwise or counterclockwise direction. Alternately, the twist cap 14 can be pushed down such that the tooth 50 by-passes the lower bead 46, and the skirt 30 of the twist cap again occupies the recess 24 of the base cap, as in FIG. 1. This position of the twist cap 14 as shown in FIG. 1 provides a more secure seal than that where the twist cap 14 is raised, since from the position of FIG. 1, turning of the twist cap in a clockwise direction is effectively prevented by the engagement of the lug 32 with the shoulder at the upper end of the cam track 28. Even though turning of the twist cap 14 in a counterclockwise direction is possible, the dispenser would not arrive at an open condition until the cam lug 32 had ridden completely up the cam track 26, and had passed the end thereof. In the position of FIG. 1, the sealing peg 42 occupies the discharge passage 44, thereby providing an additional seal downstream from the flow passages 36, 38. Accordingly, the dispensing cap is always initially assembled with the twist cap positioned as shown in FIG. 1, to minimize the possibility of inadvertent leakage during shipping and storage, distribution to warehouses, or display in merchandising outlets or department stores, etc.

Also, by the invention the lower portion 70 of the valving wall 52 is always disposed completely below the flow passages 36, 38, even when the twist cap 14 is raised as in FIG. 2. This construction prevents any liquid from flowing downwardly in this figure, toward the upper bead 48 on the spout portion 34. Since this lower portion 70 of the valving wall 52 is cylindrical, and the cooperable outer surface 72 of the spout portion 34 engaged by this valving wall portion 70 is also cylindrical, an effective seal is realized at all times, irrespective of the relative turning which occurs between the two parts. It is considered that the seal is important from the standpoint of eliminating any build up of solidified product in the area above the bead 48, which might eventually interfere with smooth operation of the dispenser. The wall of the spout portion 34 adjacent to the surface 72 and to the flow passages is tapered, as shown in FIGS. 1 and 2, with the thin portion of the taper being just beneath the respective flow passage opening 36 or 38.

The disclosed construction has a number of distinct advantages. Since the flow rate of the product being dispensed is controlled by a pair of shutters or valving wall portions that open or close by the same angular extent and at the same angular velocity as that at which the twist cap is turned, a very precise positioning of the shutters is made possible, resulting in a high degree of control, regardless of the viscosity of the substance being dispensed. A transition from a fully closed to a fully open position occurs with somewhat less than a 90° turning of the twist cap, which is convenient for the user, since multiple turns are not required, as in previous cap designs. Stated differently, turning the twist cap from the position shown in FIG. 7 to that of FIG. 6 closes off the dispenser from its fully open position, and the degree of control or resolution is seen to be high. The number of increments or steps provided is limited only by the spacing of the ribs 62 on the spout portion 34. The number of such ribs 62 can be increased if necessary, to increase the resolution or degree of control as might be required with substances of different viscosities.

The disclosed construction consists essentially of two one-piece molded parts which can be readily fabricated in relatively inexpensive mold cavities and assembled by automatic assembly equipment.

The device is thus seen to represent a distinct advance and improvement in the field of hand-held dispensers.

Variations and modifications are possible without departing from the spirit of the invention.

Each and every one of the appended claims defines an aspect of the invention which is separate and distinct from all others, and accordingly it is intended that each claim be treated as such when examined in light of the prior art devices in any determination of novelty or validity.

What is claimed is:

1. A dispensing cap construction for controlling the flow rate of a liquid, comprising, in combination:

(a) a base cap (12) attachable to a container, said base cap having a spout formation (34) with a bore, (b) a cover cap (14) which is both turnably mounted on the base cap and axially movable thereon between a lowered sealing position and a fully raised position, said cover cap having a dispensing orifice (44), (c) said base cap and cover cap having cooperable sealing means (42, 44) closing off the dispensing orifice of the cover cap when the latter is disposed in its lowered sealing position, (d) said base cap and cover cap having cooperable valving means (36, 38, 54, 56, 52) located below and spaced from said sealing means, said valving means comprising a flow passage (36, 38) on the base cap (12), said valving means further comprising a blocking shutter (54, 56) turnable with the cover cap (14), said valving means being separate and distinct from said sealing means, said valving means being responsive to turning of the cover cap when the cover cap is in its fully raised position on the base cap, for varying the liquid flow rate between the bore of the spout formation and the dispensing orifice of the cover cap.

2. The invention as set forth in claim 1, and further including:

(a) means on said base cap (12) and cover cap (14), for yieldably retaining the cover cap (14) in a raised position following initial raising of the cover cap (14).

3. The invention as set forth in claim 1, wherein:

(a) said sealing means (42, 44) is completely opened when the cover cap (14) occupies its raised position.

* * * * *